US005230274A

United States Patent [19]

Yu et al.

[11] Patent Number: 5,230,274

[45] Date of Patent: Jul. 27, 1993

[54] VARIABLE DISPLACEMENT HYDRAULIC PUMP WITH QUIET TIMING

[75] Inventors: Xudong Yu; John G. Berezinski; Steven R. Feller, all of Omaha, Nebr.

[73] Assignee: Vickers Incorporated, Troy, Mich.

[21] Appl. No.: 833,914

[22] Filed: Feb. 11, 1992

[51] Int. Cl.[5] ..... F01B 3/00

[52] U.S. Cl. ..... 91/499; 91/6.5; 91/485

[58] Field of Search ..... 91/6.5, 499, 484, 485, 91/487

[56] References Cited

U.S. PATENT DOCUMENTS 3,585,901 6/1971 Moon, Jr. ..... 91/6.5
4,920,856 5/1990 Berthold et al. ..... 91/499 X

FOREIGN PATENT DOCUMENTS 1220736 7/1966 Fed. Rep. of Germany ..... 91/487
275893 2/1990 German Democratic Rep. ... 91/499
422862 4/1974 U.S.S.R. ..... 91/499
661139 5/1979 U.S.S.R. ..... 91/499

*Primary Examiner*—Richard A. Bertsch
*Assistant Examiner*—Michael I. Kocharov
*Attorney, Agent, or Firm*—Barnes, Kisselle, Raisch Choate, Whittemore & Hulbert

[57] ABSTRACT

A fluid pressure energy translating device of the rotary, variable displacement type having a timing device providing gradual rise and reduction of pressure between the cylinder bores and the inlet and outlet ports. The timing device is in the form of a valve plate having a metering groove with a double notch design which exits into an associated outlet port, and a long single "V" notch metering groove which exits into a associated inlet port.

6 Claims, 2 Drawing Sheets

VARIABLE DISPLACEMENT HYDRAULIC PUMP WITH QUIET TIMING

BACKGROUND OF THE INVENTION

This invention relates to a variable displacement axial piston pump and, more particularly to a timing device which provides for gradual pressure rise and pressure decay as well as the prevention of fluid jet flow which only occurs at the outlet port as the cylinder bores in the cylinder barrel come into communication with the inlet and outlet ports.

The axial piston pump has a cylinder barrel rotatably mounted in a pump housing and is rotated by a drive shaft. The cylinder barrel has plurality of cylinder bores formed therein equally spaced about a common radius, each bore housing a piston which reciprocates as the barrel is rotated. One end of the cylindrical barrel rotates against a fixed valve plate mounted within the housing and which has inlet and outlet ports. Each cylinder has a port adjacent to the valve plate and as the cylinder barrel is rotated, each cylinder port cyclically communicates with the inlet and outlet ports in the valve plate. The pistons are connected through piston shoes to bear against the angled swash plate. As the cylinder barrel is turned by the drive shaft, the piston shoes follow the swash plate and cause the pistons to reciprocate. The inlet and outlet ports in the valve plate are arranged so that the pistons pass the low pressure inlet as they are being pulled out and pass the high pressure outlet as they are being forced back in.

It is important that proper timing be used to communicate the valve plate inlet and outlet ports to the cylinder bores. Proper timing is achieved by selecting the optimal length, depth and width of the metering grooves as well as their proper radial location. Improper timing directly contributes to problems such as high noise level, pressure pulsations, erosion, high yoke moments, poor volumetric efficiency, poor fill capability, and jet flow. Ideally, the fluid in the piston chamber should be decompressed and precompressed to the system pressure level before communicating the piston chamber to the valve plate inlet and outlet ports, however, this is not possible for all conditions of speed and pressure.

In the past, metering grooves have been used to help achieve decompression and precompression. However, jet flow problems occur when, for example, during precompression, the pressure differential between the outlet port and the cylinder bore is great, the pressure within the outlet port being substantially higher than that within the cylinder bore. As the metering groove comes into communication with the outlet port, high pressure fluid is forced back through the small metering groove from the high pressure outlet port and back into the piston chamber creating a fluid jet flow effect. The high velocity of the fluid through the metering groove pulls air out of solution. This aerated fluid, when subjected to the impact of high pressure, will result in high pressure pulsations which are directly related to the noise level of the unit, as well as contributing to erosion of the valve plate as the high velocity fluid flows through the small metering grooves.

To prevent high velocity fluid flow through the small metering grooves which contribute to the above mentioned problems, it is desirable to provide a double notched metering groove at the outlet port, and a long "V" notch metering groove at the inlet port.

SUMMARY OF THE INVENTION

According to the present invention, an improved valve plate timing device is provided for in a variable displacement axial piston pump. More specifically, a double notch metering groove is provided for communicating with the outlet port, and a single "V" notch metering groove is provided to communicate with the inlet port.

An important feature of the invention resides in the fact that during precompression, for example, as the fluid in the cylinder bore is compressed, the initial long "V" notch portion of the metering groove provides for gradual pressure rise in the cylinder bore thus reducing the pressure differential between the cylinder bore and the outlet port. The second and wider section of the double notch of the metering groove connects the long "V" notch portion with the outlet port and even further reduces the pressure differential thus reducing the fluid flow rate to prevent the fluid jet flow effect as the pressurized cylinder bore communicates with the outlet port in the valve plate.

Similarly, on the opposite side of the valve plate, as the cylinder bore comes into communication with the low pressure valve plate inlet port and its associated metering groove, the long single "V" notch metering groove provides for gradual pressure reduction, again, reducing the problems of noise, pressure pulsations and erosion.

DESCRIPTION OF PREFERRED EMBODIMENTS

Figure 1:
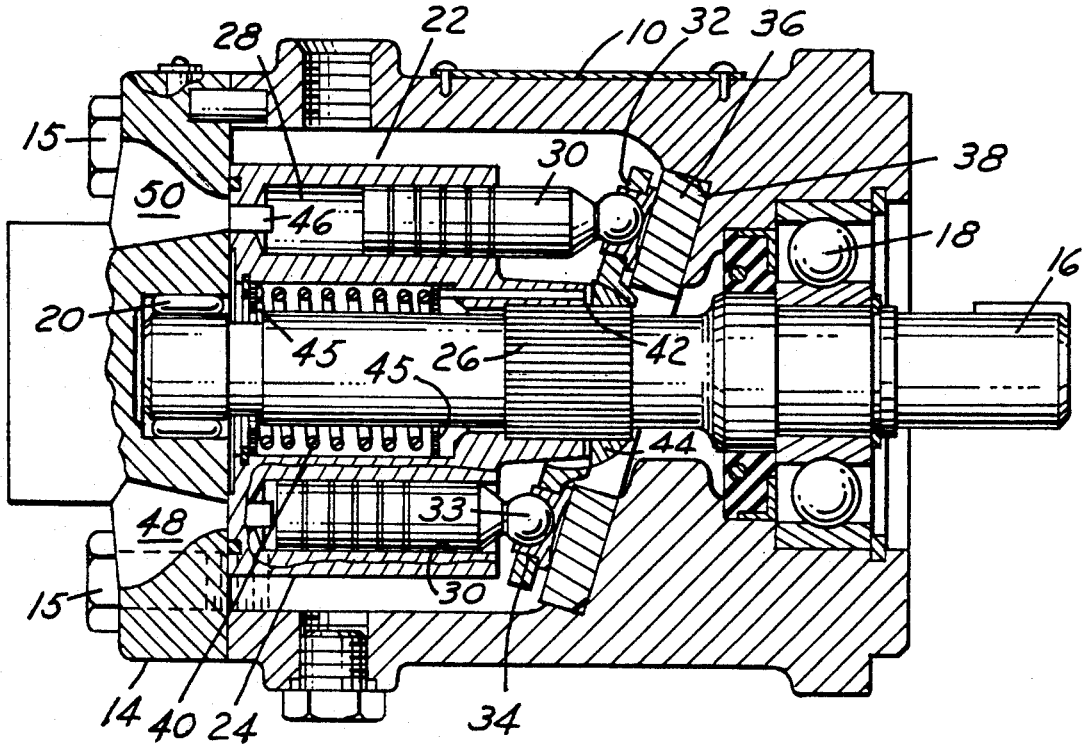
FIG. 1 is a cross section of a typical pump.

Referring now to FIG. 1, an axial piston pump has a housing 10, a valve plate 14 which includes an inlet port 48 and an outlet port 50 and is connected to the housing by bolts 15.

A drive shaft 16 is rotatably supported in housing 10 by bearing 18 in one end of the housing 10 and bearing 20 in the valve plate 14. The housing 10 has an inner cavity 22 which receives a cylinder barrel 24 rotatably mounted therein and is drivingly connected to the drive shaft 16 by a drive spline 26.

The cylinder barrel 24 has a plurality of bores 28 open at one end to receive a piston 30. Each piston is connected to a shoe plate 32, by having a ball shaped head 33 received within a socket in shoe 34.

Each shoe 34 bears against an angled swash plate 36. The swash plate 36 engages an inclined back face 38 formed at one end of the cavity 22 so that as the barrel 24 is rotated by drive shaft 16, piston shoes 34 follow the swash plate 36, causing the pistons to reciprocate within the bores 28. The shoe plate 32 is biased into engagement with swash plate 36 by a spring force acting through spring 40, pins 42, and spherical washer 44. Spring 40 is held by retainers 45 secured within the barrel 24.

Each bore 28 has a port 46 opposite its open end which communicates fluid between valve plate 14 and the bore 28. Both an inlet port 48 and an outlet port 50 are formed within the valve plate 14.

The inlet and outlet ports 48, 50, are arranged in the valve plate 14 so that the pistons 30 pass the inlet port 48 as they are being pulled away from the valve plate 14 and are forced back in toward the valve plate 14 as they pass outlet port 50.

In normal operation, system pressure at the outlet port 50 is higher than the pressure within any of the cylinder bores 28. As the bore 28 approaches the high pressure outlet port 50, the piston 30 is forced inwardly toward the valve plate 14 increasing the pressure within the bore 28. It is desirable to have the lowest possible pressure differential between the bore 28 and high pressure outlet port 50. Little or no pressure differential would prevent high pressure fluid from blowing back into the bore 28 from the outlet port 50 as the bore passes the outlet port.

After the bore 28 has passed outlet port 50, the pressure within the bore 28 is still substantially high compared to the low system pressure at the inlet port 48. Again, it is desirable to have little or no pressure differential between low pressure inlet port 48 and the high pressure in bore 28 to prevent fluid from being blown or forced back into inlet port 48 when the inlet communicates with the bore. The piston 30 is pulled away from the valve plate 14 thus reducing pressure within the bore. However, pressure in the bore is still higher than system pressure at the inlet port 48.

Figure 2:
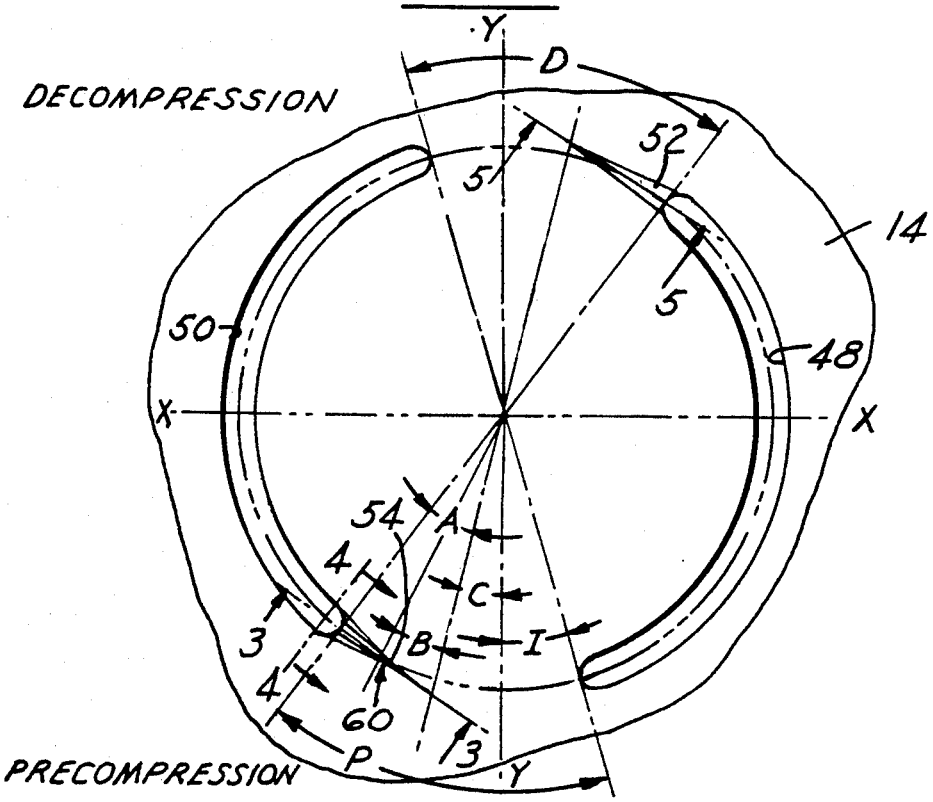
FIG. 2 is a front view of the valve plate timing device of the present invention.

Referring to FIG. 2, it can be seen that the inlet and outlet ports 48, 50 are in the form of arcuate slots, the center lines thereof forming a circle. A first vertical diameter Y—Y in FIG. 2 represents the stroke of a piston with the upper most point on the circle indicating top dead center, or a position of the piston when the piston is furthest into the bore. The area between the ends of the outlet and inlet ports 50, 48, including the entire decompression metering groove 52, is referred to as the area of decompression "D". An area of precompression "P" extends between the opposite ends of the inlet and outlet ports 48, 50, and includes precompression metering groove 54. The ends of the outlet port 50 at decompression "D" and the inlet port 48 at precompression "P" are located an angular distance I, for example 17°, from the first diameter Y—Y. At the precompression end of the outlet port 50 and the decompression end of the inlet port 48, metering grooves comprising a precompression groove 54 and a decompression groove 52 are provided to reduce the pressure differential by gradually increasing communication between the cylinder bores 28 and the outlet and inlet port 50, 48. The decompression and precompression metering grooves 52, 54 extend circumferentially away from the inlet port 48 and outlet port 50, respectively, in the counter clockwise direction. The center lines of the decompression and precompression metering grooves 52, 54 are approximately tangent to the circle formed by the center line of the outlet port 50 and inlet port 48.

Figure 3:
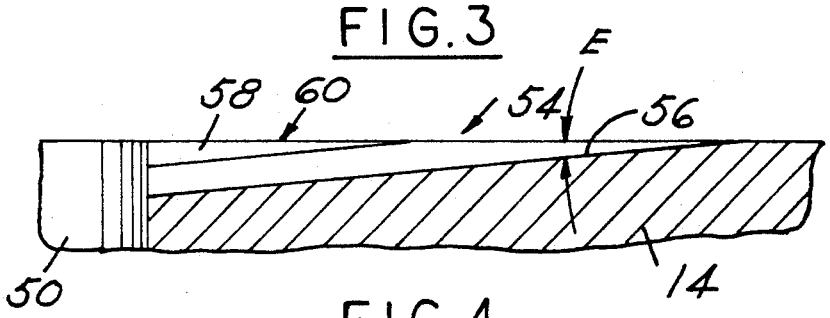
FIG. 3 is a view taken along line 3—3 in FIG. 2.
Figure 4:
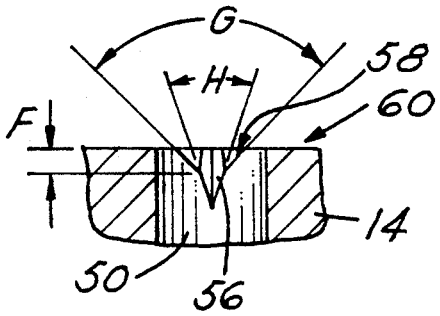
FIG. 4 is a view taken through line 4—4 in FIG. 2.

Referring to FIGS. 2, 3 and 4, it can be seen that the precompression metering groove 54 is in the form of a double notch design. A first long notch 56 has a substantially narrow width the walls of which form an acute angle H (FIG. 4) of at least 45°. The first long notch 56 extends circumferentially away from the outlet port 50 and ends at a point on a second diameter which forms an angle A of, for example, about 29° with a third diameter extending substantially tangent to the precompression end of the outlet port 50. The second diameter forms an angle C with the first diameter Y—Y, for example, of approximately 9°, which is substantially smaller than angle A. The precompression metering groove 54 includes a second wider notch 58 formed in conjunction therewith, the walls being at an included angle G of not more than 90° but greater than the included angle H of the notch 56. The length of the second wider notch 58 is less than that of first notch 56. The second wider notch 58 ends at a fourth diameter which forms an angle B, approximately 22° with the second diameter. The angle B is greater than angle C but less than angle A. The depth of the first long notch 56 extends at a small angle E, such as 7° from the top surface of the valve plate to the end of the outlet port. The depth of the second wider notch 58 extends at the same small angle E, and is a distance F, such as, 0.008 inches maximum, from the surface of the valve plate as shown in FIG. 4.

Figure 5:
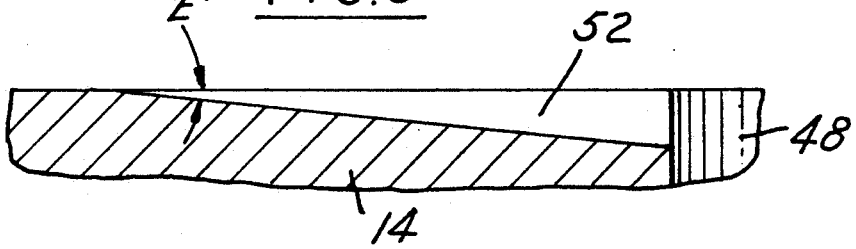
FIG. 5 is a view taken through line 5—5 in FIG. 2.

From FIG. 5, it can be seen that the decompression metering groove 52 is a single long "V" notch. There is no double notch at the inlet port because problems associated with jet flow do not occur at the inlet port. The dimensions of the decompression metering groove 52 are substantially the same as long notch 56 of the precompression metering groove 54 except that the depth of the decompression metering groove 52 slopes at a smaller angle E' of, for example, about 3°.

Referring to FIG. 2, as a bore rotates clockwise, it moves out of communication with the outlet port 50 and into communication with decompression metering groove 52 before fully communicating with the inlet port 48. The decompression area "D" allows gradual pressure reduction in the bore through the decompression metering groove 52 as the bore approaches the low pressure inlet port 48 and communicates fluid into the bore through port 46 as the pistons 30 are withdrawn.

As the bore leaves inlet port 48, it enters the precompression area "P". When the bore approaches outlet port 50 the pistons 30 are forced inwardly to compress the fluid within the bore. As the bore communicates with the precompression metering groove 54, the compressed fluid within bore 28 is forced to flow into the first long notch 56, into the second wider notch 58 of the double notch design 60 and into the outlet port 50. It can be seen that the double notch design 60 allows the fluid, as it flows from the first long notch 56 to the outlet 50, to expand and reduce the flow rate between the first long notch 56 and the outlet 50. The first long notch 56 allows for gradual pressure increase in the bore 28. The second wider notch 58 allows the bore 28 to further adjust to the high pressure outlet port 50 thus reducing pressure differential and smoothing the flow of fluid from the bore 28 to the outlet port. The reduction of pressure differential helps prevent fluid jet flow from the outlet to the bore.

Proper timing is a critical aspect of the present invention. Therefore, the dimensions of length, width and depth of both metering grooves are important in achieving proper timing. For instance, the width of the first long notch 56 should not be less than 45° because the life of the device would be substantially shortened due to wear. The width of the second wider notch 58 should not extend over 90° because it would extend over the width of the outlet port 50 resulting in both fluid and pressure loss. The long length of the metering grooves communicate the cylinder bores with the inlet and outlet ports sooner than earlier devices and thus more effectively reduce the pressure differential therebetween.

The metering grooves 52, 54 (with the double notch design 60) allow for optimal reduction of the pressure differential between the bores 28 and the inlet and outlet ports 48, 50 before the bores 28 come into full communication therewith.

According to the present invention, the long "V" notch metering groove at the inlet port and the double notch metering groove at the outlet port help to even further eliminate the pressure differential between the cylinder bores and the inlet and outlet ports. This is achieved by controlling the rate of flow of fluid between the metering grooves and the inlet and outlet ports to reduce or eliminate the fluid jet flow and the detrimental effects caused thereby.

We claim:

1. A fluid pressure energy translating device of the rotary, variable displacement type comprising:

a housing;

a drive shaft rotatably supported in said housing;

a cylinder barrel in driving engagement with said drive shaft and having a plurality of cylinder bores with an open end and port means at the other end;

a shoe plate in driving engagement with said drive shaft;

a plurality of pistons each having one end slidably mounted within the open end of said cylinder bores and having the opposite end connected to a shoe mounted within said shoe plate;

an inclined swash plate disposed at one end of said housing and disposed within said cylinder barrel for engagement with said shoe plate;

valve plate means at the other end of said housing and having inlet and outlet ports to cyclically communicate fluid to and from said cylinder bores, said inlet and outlet ports defining areas of precompression and decompression extending an angular distance between their respective ends;

a precompression groove associated with the outlet port at the area of precompression and a decompression groove associated with the inlet port at the area of decompression to gradually increase and decrease fluid pressure between said cylinder bores and said inlet and outlet ports respectively, as the cylinder bores enter into said precompression and decompression areas, respectively, and wherein said precompression groove includes a double notch along a portion the length thereof to further reduce fluid pressure between the output port and the cylinder bores, said inlet and outlet ports comprising circumferentially spaced arcuate grooves the center lines of which form a circle, said precompression and decompression grooves extending circumferentially away from the outlet port and said inlet port, respectively, and ending at a diameter forming a first angle A greater than half of the angular distance of the precompression and decompression areas, and wherein the double notch ends at a diameter forming a second angle B less than the first angle A.

2. A fluid pressure energy translating device of the rotary, variable displacement type comprising:

a housing;

a drive shaft rotatably supported in said housing;

a cylinder barrel in driving engagement with said drive shaft and having a plurality of cylinder bores with an open end and port means at the other end;

a shoe plate in driving engagement with said drive shaft;

a plurality of pistons each having one end slidably mounted within the open end of said cylinder bores and having the opposite end connected to a shoe mounted within said shoe plate;

an inclined swash plate disposed at one end of said housing and disposed within said cylinder barrel for engagement with said shoe plate;

valve plate means at the other end of said housing and having inlet and outlet ports to cyclically communicate fluid to and from said cylinder bores, said inlet and outlet ports defining areas of precompression and decompression extending an angular distance between their respective ends;

a precompression groove associated with the outlet port at the area of precompression and a decompression groove associated with the inlet port at an area of decompression to gradually increase and decrease fluid pressure between said cylinder bores and said inlet and outlet ports, respectively, as the cylinder bores enter into said precompression and decompression areas, respectively, and wherein said precompression groove includes a double notch along a portion the length thereof to further reduce fluid pressure between the outlet port and the cylinder bores, said inlet and outlet ports comprising circumferentially spaced arcuate grooves the center lines of which form a circle, said precompression and decompression grooves extending circumferentially away from said outlet port and said inlet port, respectively, and ending at a diameter forming a first angle A greater than half of the angular distance of the precompression and decompression areas, wherein said double notch is formed by a first long narrow groove, the walls of which form an acute angle H, and a second short wider groove formed in conjunction therewith, the walls of which form an angle G greater than said acute angle H, and the bottom of the first long narrow groove slopes from one end in a direction toward said outlet port at a small angle E and, the junction of the walls of the first long narrow groove and the second short wider groove slopes at the same angle E as the bottom of the first long narrow groove, but for a much shorter distance.

3. A fluid pressure energy translating device of the rotary, variable displacement type comprising;

a housing;

a drive shaft rotatably supported in said housing;

a cylinder barrel in driving engagement with said drive shaft and having a plurality of cylinder bores with an open end and port means at the other end;

a shoe plate in driving engagement with said drive shaft;

a plurality of pistons each having one end slidably mounted within the open end of said cylinder bores and having the opposite end connected to a shoe mounted within said shoe plate;

an inclined swash plate disposed at one end of said housing and disposed within said cylinder barrel for engagement with said shoe plate;

valve plate means at the other end of said housing and having inlet and outlet ports to cyclically communicate fluid to and from said cylinder bores, said inlet and outlet ports defining areas of precompression and decompression extending an angular distance between their respective ends;

a precompression groove associated with the outlet port at the area of precompression and a decompression groove associated with the inlet port at the area of decompression to gradually increase and decrease fluid pressure between said cylinder bores and said inlet and outlet ports, respectively, as the cylinder bores enter into said precompression and decompression areas, respectively, and wherein said precompression groove includes a double notch along a portion the length thereof to further reduce fluid pressure between the outlet port and the cylinder bores, said inlet and outlet ports comprising circumferentially spaced arcuate grooves the center lines of which form a circle, said precompression and decompression grooves extending circumferentially away from said outlet port and said inlet port, respectively, and ending at a diameter forming a first angle A greater than half of the angular distance of the precompression and decompression areas, wherein said precompression grooves has walls forming an acute angle of at least 45°, and wherein the walls at the double notch are outwardly flared forming an angle of not more than 90°.

4. A fluid pressure energy translating device of the rotary, variable displacement type comprising a housing;

a drive shaft rotatably supported in said housing;

a cylinder barrel in driving engagement with said drive shaft and having a plurality of cylinder bores with an open end and port means at the other end;

a shoe plate in driving engagement with said drive shaft;

a plurality of pistons each having one end slidably mounted within the open end of said cylinder bores and having the opposite end connected to a shoe mounted within said shoe plate;

an inclined swash plate disposed at one end of said housing and disposed within said cylinder barrel for engagement with said shoe plate;

valve plate means at the other end of said housing and having inlet and outlet ports to cyclically communicate fluid to and from said cylinder bores, said inlet and outlet ports defining areas of precompression and decompression extending an angular distance between their respective ends; and a precompression groove associated with said outlet port, said precompression groove having a center line approximately tangent to a circle formed by a center line of said inlet and outlet ports, such that said precompression groove extends circumferentially away from the outlet port at the area of precompression and a decompression groove associated with said inlet port, said decompression groove having a center line approximately tangent to a circle formed by a center line approximately tangent to a circle formed by a center line of said inlet and outlet ports, such that said decompression groove extends circumferentially away from the inlet port at the area of decompression to gradually increase and decrease fluid pressure between said cylinder bores and said inlet and outlet ports, respectively, as the cylinder bores enter into said precompression and decompression areas, respectively, and wherein said precompression groove includes a double notch along a portion of the length thereof to further reduce fluid pressure between the outlet port and the cylinder bores;

said inlet and outlet ports comprising circumferentially spaced arcuate grooves the center lines of which form a circle, said precompression and decompression grooves extending circumferentially away from said outlet port and said inlet port, respectively, and ending at a diameter forming a first angle A greater than half of the angular distance of the precompression and decompression areas, the double notch ends at a diameter forming a second angle B being less than the first angle A.

5. A fluid pressure energy translating device of the rotary, variable displacement type comprising a housing;

a drive shaft rotatably supported in said housing;

a cylinder barrel in driving engagement with said drive shaft and having a plurality of cylinder bores with an open end and port means at the other end;

a shoe plate in driving engagement with said drive shaft;

a plurality of pistons each having one end slidably mounted within the open end of said cylinder bores and having the opposite end connected to a shoe mounted within said shoe plate;

an inclined swash plate disposed at one end of said housing and disposed within said cylinder barrel for engagement with said shoe plate;

valve plate means at the other end of said housing and having inlet and outlet ports to cyclically communicate fluid to and from said cylinder bores, said inlet and outlet ports defining areas of precompression and decompression extending an angular distance between their respective ends; and a precompression groove associated with said outlet port, said precompression groove having a center line approximately tangent to a circle formed by a center line of said inlet and outlet ports, such that said precompression groove extends circumferentially away from the outlet port at the area of precompression and a decompression groove associated with said inlet port, said decompression groove having a center line approximately tangent to a circle formed by a center line approximately tangent to a circle formed by a center line of said inlet and outlet ports, such that said decompression groove extends circumferentially away from the inlet port at the area of decompression to gradually increase and decrease fluid pressure between said cylinder bores and said inlet and outlet ports, respectively, as the cylinder bores enter into said precompression and decompression areas, respectively, and wherein said precompression groove includes a double notch along a portion of the length thereof to further reduce fluid pressure between the outlet port and the cylinder bores;

said inlet and outlet ports comprising circumferentially spaced arcuate grooves the center lines of which form a circle, said precompression and decompression grooves extending circumferentially away from said outlet port and said inlet port, respectively, and ending at a diameter forming a first angle A greater than half of the angular distance of the precompression and decompression areas, said double notch being formed by a first long narrow groove, the walls of which form an acute angle H, and a second short wider groove formed in conjunction therewith, the walls of which form an angle G greater than said acute angle H, the bottom of the first long narrow groove sloping from one end in a direction toward said outlet port at a small angle E and, the juncture of the walls of the first long narrow groove and the second short wider groove sloping at the same angle E as the bottom of the first long narrow groove, but for a much shorter distance.

6. A fluid pressure energy translating device of the rotary, variable displacement type comprising a housing;

a drive shaft rotatably supported in said housing;

a cylinder barrel in driving engagement with said drive shaft and having a plurality of cylinder bores with an open end and port means at the other end;

a shoe plate in driving engagement with said drive shaft;

a plurality of pistons each having one end slidably mounted within the open end of said cylinder bores and having the opposite end connected to a shoe mounted within said shoe plate;

an inclined swash plate disposed at one end of said housing and disposed within said cylinder barrel for engagement with said shoe plate;

valve plate means at the other end of said housing and having inlet and outlet ports to cyclically communicate fluid to and from said cylinder bores, said inlet and outlet ports defining areas of precompression and decompression extending an angular distance between their respective ends; and a precompression groove associated with said outlet port, said precompression groove having a center line approximately tangent to a circle formed by a center line of said inlet and outlet ports, such that said precompression groove extends circumferentially away from the outlet port at the area of precompression and a decompression groove associated with said inlet port, said decompression groove having a center line approximately tangent to a circle formed by a center line approximately tangent to a circle formed by a center line of said inlet and outlet ports, such that said decompression groove extends circumferentially away from the inlet port at the area of decompression to gradually increase and decrease fluid pressure between said cylinder bores and said inlet and outlet ports, respectively, as the cylinder bores enter into said precompression and decompression areas, respectively, and wherein said precompression groove includes a double notch along a portion of the length thereof to further reduce fluid pressure between the outlet port and the cylinder bores;

said precompression groove having walls forming an acute angle of at least 45°, and wherein the walls at the double notch are outwardly flared forming an angle of not more than 90°.

* * * * *